US005438401A

United States Patent [19]

Murayama et al.

[11] Patent Number: 5,438,401

[45] Date of Patent: Aug. 1, 1995

[54] MULTICOLOR IMAGE FORMING METHOD AND APPARATUS THEREFOR

[75] Inventors: Hisao Murayama, Yokohama; Hitoshi Ishibashi, Tokyo, both of Japan

[73] Assignee: Ricoh Company, Ltd., Tokyo, Japan

[21] Appl. No.: 311,716

[22] Filed: Sep. 23, 1994

Related U.S. Application Data

[63] Continuation of Ser. No. 987,815, Dec. 9, 1992, abandoned.

[30] Foreign Application Priority Data

Dec. 9, 1991 [JP] Japan ..... 3-350004
Mar. 31, 1992 [JP] Japan ..... 4-077354
Oct. 3, 1992 [JP] Japan ..... 4-289284

[51] Int. Cl.[6] ..... G03G 15/01

[52] U.S. Cl. ..... 355/326 R; 355/219; 355/225; 430/42

[58] Field of Search ..... 355/214, 216, 219, 225, 355/326, 327, 328; 346/157; 430/42, 54

[56] References Cited

U.S. PATENT DOCUMENTS 4,927,724 5/1990 Yamamoto et al. ..... 355/326
4,959,669 9/1990 Haneda et al. ..... 355/326 X

FOREIGN PATENT DOCUMENTS 91251 7/1981 Japan .
296063 12/1988 Japan .

*Primary Examiner*—Benjamin R. Fuller
*Assistant Examiner*—John E. Barlow, Jr.
*Attorney, Agent, or Firm*—Oblon, Spivak, McClelland, Maier & Neustadt

[57] ABSTRACT

An image forming apparatus capable of producing pure and clear-cut bicolor images stably over a long period of time. After a photoconductive element has been uniformly charged by a first charger, a first latent image is formed on the element by first exposure. The first latent image is developed by a black toner stored in a first developing unit. Subsequently, after the photoconductive element has been charged by a second charger implemented by a scorotron charger, a second latent image is formed on the element by second exposure. The second latent image is developed by a red toner stored in a second developing unit by reversal development. The resulting two toner images are transferred to a recording medium. The grid voltage of the second charger is selected to be lower than the potential deposited on the photoconductive element by the first charger. As a result, the portion of the image carrier where the black toner is deposited by the second developing unit has a lower potential than the portion where the black toner is not deposited. This increases the difference between the potential of the portion where the black toner is not deposited and the bias potential for development, thereby insuring a margin against the contamination of the background. At the same time, the difference between the potential of the portion where the black toner is deposited and the bias potential for development is reduced to prevent the black toner from flying away from the photoconductive element.

21 Claims, 15 Drawing Sheets

VD1
0

VL1

VB1
TONER OF 1ST COLOR

VD2
TONER OF 1ST COLOR
0

VL2

VB2
TONER OF 2ND COLOR $V_{G2} = V_{G1} = 600$ [V], $I_{CC1} = 650$ [μA]

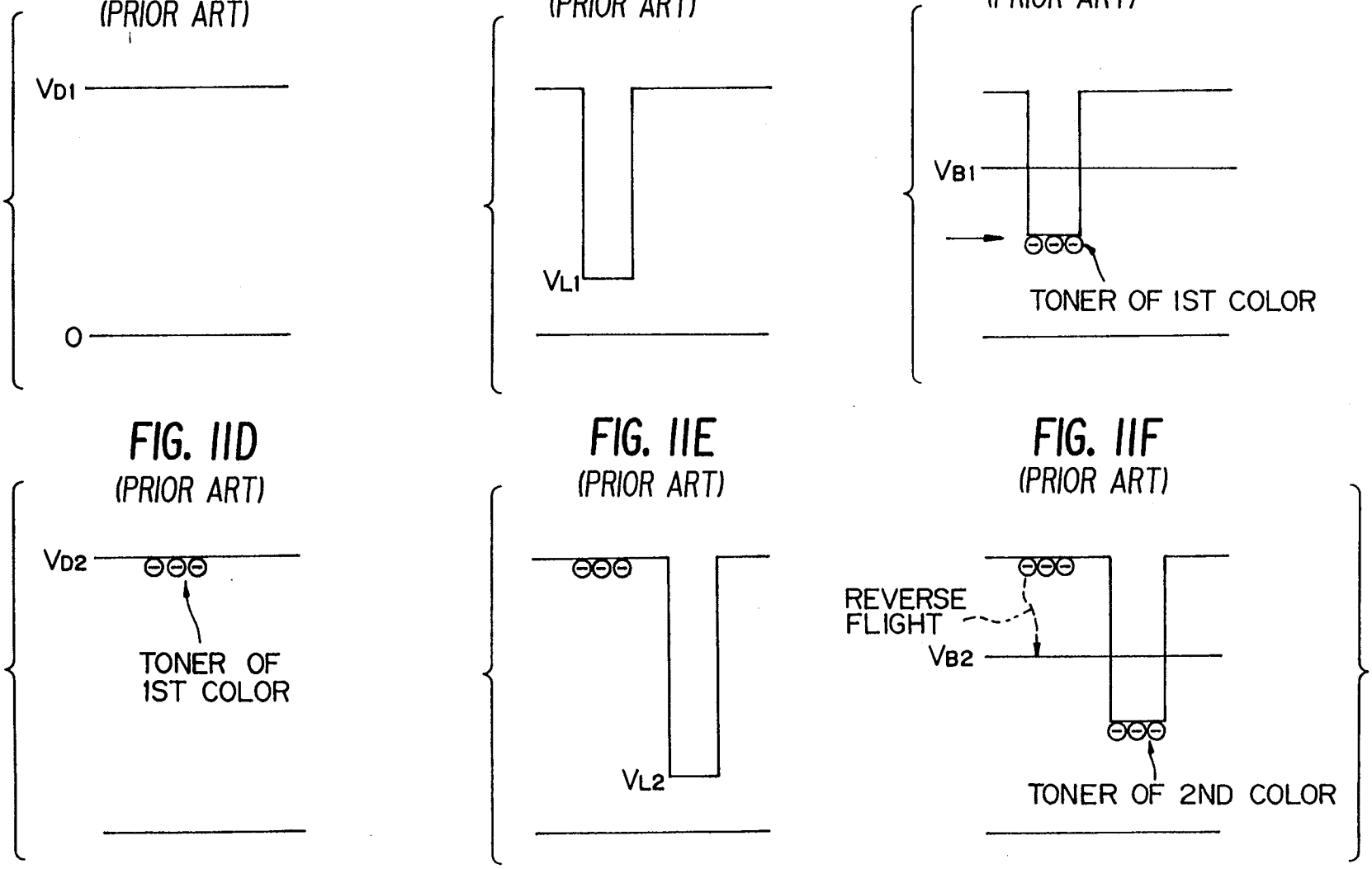
FIG. IIA
(PRIOR ART)
VD1
0
FIG. IIB
(PRIOR ART)
VL1
FIG. IIC
(PRIOR ART)
VB1
TONER OF 1ST COLOR
FIG. IID
(PRIOR ART)
VD2
TONER OF
1ST COLOR
FIG. IIE
(PRIOR ART)
VL2
FIG. IIF
(PRIOR ART)
REVERSE
FLIGHT
VB2
TONER OF 2ND COLOR

MULTICOLOR IMAGE FORMING METHOD AND APPARATUS THEREFOR

This application is a Continuation of application Ser. No. 07/987,815, filed on Dec. 9, 1992, now abandoned.

BACKGROUND OF THE INVENTION

The present invention relates to a method of forming a multicolor image and, more particularly, to a multicolor image forming method for executing, after a toner image has been formed on an image carrier by a sequence of charging, exposing and developing steps, another sequence of charging, exposing and developing steps using a toner different in tone from the toner of the toner image existing on the image carrier to thereby form toner images of at least two colors on a single image carrier one above the other. The present invention is also concerned with an apparatus for practicing such a method.

Image forming methods capable of forming multicolor images, e.g., bicolor images are disclosed in, for example, Japanese Patent Laid-Open Publication Nos. 23952/1982, 116553/1983, and 121349/1084. Basically, the conventional bicolor image forming methods commonly involve a first charging step which uniformly charges the surface of an image carrier to a potential of negative polarity, a first exposing step for exposing the charged surface of the image carrier by image data associated with a toner image of first color to form a first electrostatic latent image, a first developing step for developing the first latent image by a negatively charged toner of first color under the application of a bias and by reversal development so as to form a toner image of first color, a second charging (recharging) step for recharging the image carrier carrying the toner image of first color to a uniform potential, a second exposing step for exposing the recharged surface of the image carrier to image data associated with a toner of second color to form a second electrostatic latent image, and a second developing step for developing the second latent image by a toner of second color and of the same polarity as the image carrier under the application of a bias and by reversal development.

After the sequence of steps stated above, the bicolor toner image is transferred to a paper or similar recording medium and then fixed. Usually, the second developing step is implemented by a non-contact developing system to prevent the toner image of first color from being disturbed, i.e., prevent the different colors from being mixed and prevent the toner image from being disfigured.

Japanese Patent Laid-Open Publication No. 17464/1985 teaches a bicolor image forming method which increases the surface potential of a toner layer developed a first electrostatic latent image to an anti-color mixture potential close to the initial surface potential. Specifically, this method applies an AC voltage with at least a predetermined DC voltage component thereof made offset in the event of the second charging step, thereby increasing the potential of the image portion of the image carrier.

Japanese Patent Laid-Open Publication No. 127082/1991 proposes an implementation for preventing the toner of second color from being mixed with the toner of first color by maintaining the charge potential of the second charging step higher than that of the first charging step at all times.

Further, Japanese Patent Publication Nos. 45916/1989 and 22947/1990 disclose methods which make the potential of the image portion of the image carrier substantially equal to the potential of the non-image portion in the second charging (recharging) step.

However, the problem with the conventional methods is that as the iterative image forming steps, i.e., the first charging step to the second developing steps are performed over a long period of time, the toner image of second color becomes impure and this degrades the image quality as a whole. This stems from the fact that during the non-contact second developing step the toner image of first color flies reversely from the image carrier to the developing unit storing the toner of second color. This is also true with a multicolor image consisting of toner images of three or more colors. Further, when the charge potential of the second charging step is higher than that of the first charging step, the ripple of potential occurred on the surface of the image carrier during the first charging step is superposed on the ripple of potential occurring during the second charging step. As a result, the ripple width is apt to increase. In addition, increasing the charge potential brings about various problems in respect of power consumption, service life of the image carrier, ozone ascribable to the high voltage, etc. Therefore, the charge potential for the second charging step should preferably be equal to or lower than that for the first charging step.

SUMMARY OF THE INVENTION

It is, therefore, an object of the present invention to provide a multicolor image forming apparatus capable of forming pure and clear-cut multicolor images stably over a long period of time, and an apparatus therefor.

A multicolor image forming method for forming toner images of at least two colors one above the other of the present invention comprises the steps of charging the image carrier in a predetermined manner such that a portion of the image carrier where a toner forming a preceding toner image of at least one color is absent has a higher potential than a portion of the image carrier where the toner is present, and forming, after the charging, the next latent image on the image carrier and developing the next latent image by reversal development and by using a toner having a different tone from the toner forming the preceding toner image.

A multicolor image forming apparatus for forming toner images of at least two colors on an image carrier one above the other of the present invention comprises a charger for charging the image carrier in a predetermined manner such that a portion of the image carrier where a toner forming a preceding toner image of at least one color is present has a lower potential than a portion of the image carrier where the toner is absent, and a developing unit for forming, after the charging, the next latent image on the image carrier and developing the next latent image by reversal development and by using a toner having a different tone from the toner forming the preceding toner image.

BRIEF DESCRIPTION OF THE DRAWINGS

The above and other objects, features and advantages of the present invention will become more apparent from the following detailed description taken with the accompanying drawings in which:

FIG. 11 shows the surface potentials of a photoconductive element deposited by a conventional sequence of image forming steps.

DESCRIPTION OF THE PREFERRED EMBODIMENTS

Figures 1A, 1B, 1C, 1D, 1E, 1F:
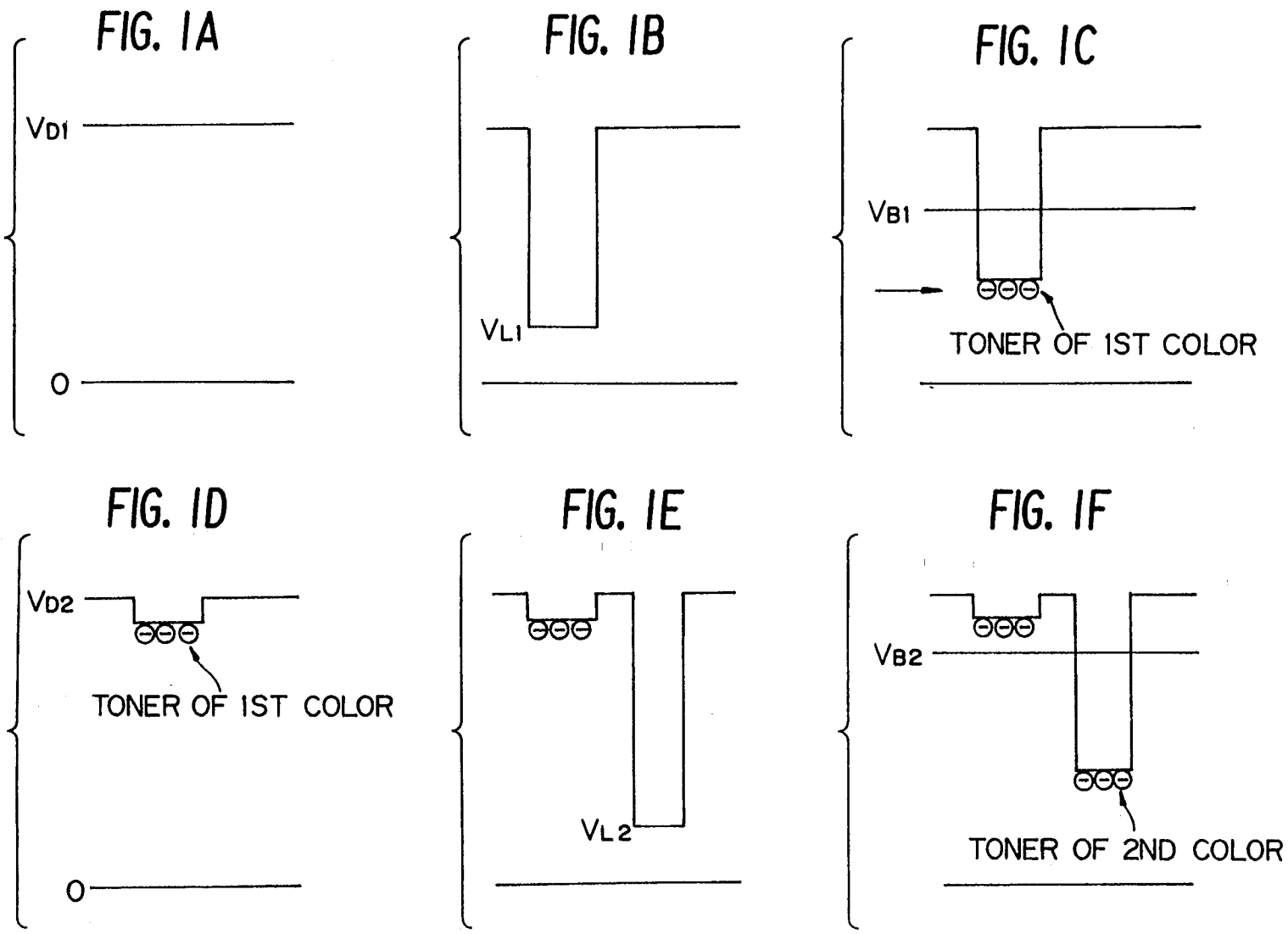
FIG. 1 shows the surface potentials of a photoconductive element deposited by a sequence of steps particular to a bicolor image forming method embodying the present invention.

To better understand the present invention, a brief reference will be made to a conventional bicolor image forming method of the kind taught in Japanese Patent Laid-Open Publication Nos. 23952/1982, 116553/1983, and 121349/1984. As shown in FIG. 1, the conventional method basically involves the following sequence of steps:

(I) First charge:

The surface of an image carrier is uniformly charged to a potential $V_{D1}$ of negative polarity.

(II) First exposure:

Image data associated with a toner image of first color exposes the charged surface of the image carrier to form a first electrostatic latent image of potential $V_{L1}$.

(III) First development:

The first latent image developed by a negatively charged toner of first color under the application of a bias $V_{B1}$ and by reversal development. As a result, a toner image of first color is formed on the image carrier.

(IV) Second charge (recharge):

The image carrier carrying the toner image of first color is recharged to a uniform potential $V_{D2}$, including the toner image of first color.

(V) Second exposure:

Image data associated with a toner of second color exposes the recharged surface of the image carrier to form a second electrostatic latent image of potential $V_{L2}$.

(VI) Second development:

The second latent image developed by a toner of second color and of the same polarity as the image carrier under the application of a bias $V_{B2}$ and by reversal development.

A bicolor toner image formed on the image carrier by the above procedure is transferred to a paper or similar recording medium and then fixed on the medium. Usually, the second development (VI) is implemented by a non-contact developing system to prevent the toner image of first color from being disturbed, i.e., prevent the different colors from being mixed and prevent the toner image from being disfigured.

However, as the iterative steps (I)–(VI) stated above are performed over a long period of time, the toner image of second color becomes impure and this degrades the image quality as a whole, as discussed earlier. This is also true with a multicolor image consisting of toner images of three or more colors.

Figure 12A:
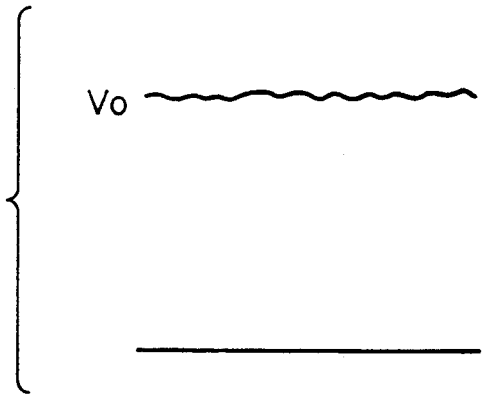
FIG. 12A (PRIOR ART)
FIG. 12 shows ripples occurring after the first and second charging steps included in a conventional bicolor image forming method.
Figure 12B:
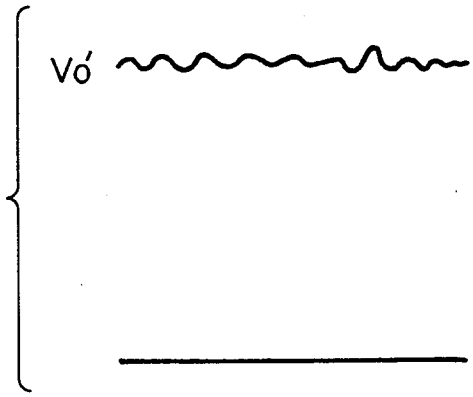
FIG. 12B (PRIOR ART)

Further, assume that the charge potential in the second charge (recharge) (IV)is higher than the charge potential in the first charge (I). Then, the ripple of potential Vo ((I), FIG. 12) occurring on the surface of the image carrier during the first charge (I) is superposed on the ripple of potential Vo' ((IV), FIG. 12) occurring during the second charge (IV). As a result, the ripple width is apt to increase, as indicated by (II) in FIG. 12.

Figure 2:
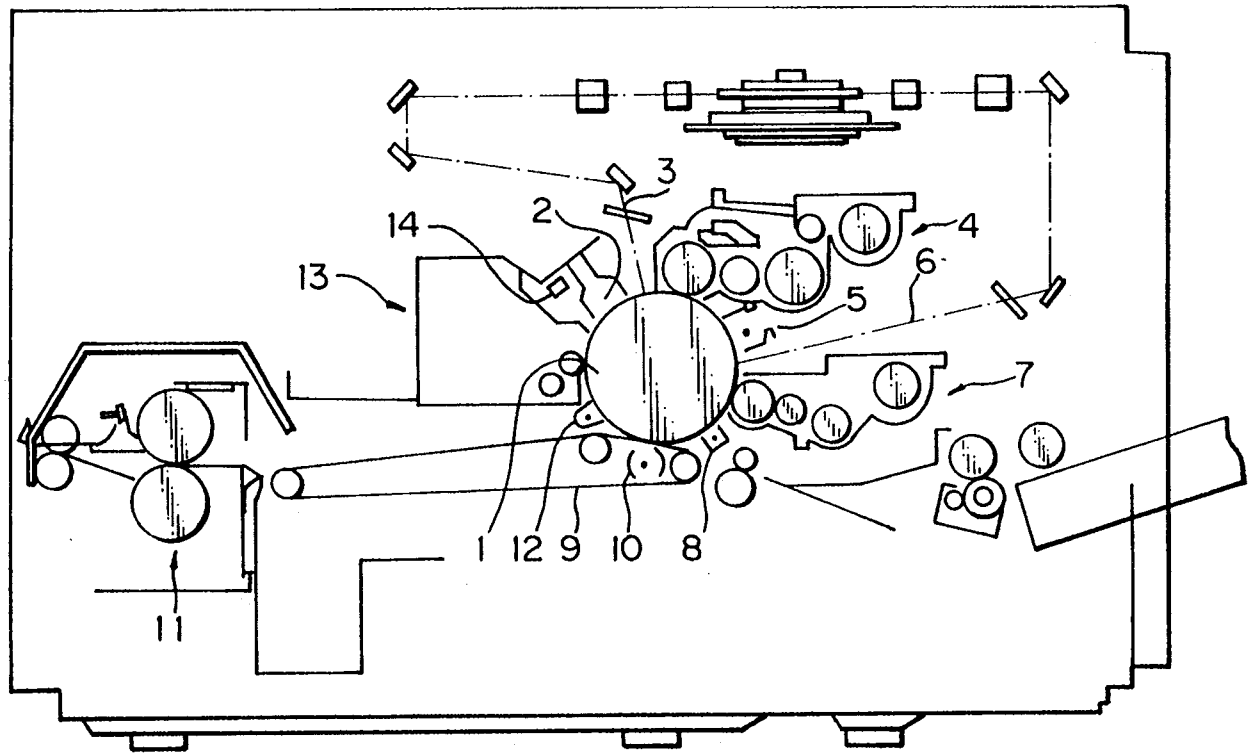
FIG. 2 is a sectional side elevation of an image forming apparatus with which the embodiment of the invention is practiced.

Referring to FIG. 2, an image forming apparatus to which a bicolor image forming method embodying the present invention is practiced is shown and implemented as an electrophotographic copier. As shown, the copier has a negatively chargeable photoconductive element in the form of a drum 1. The drum 1 is rotated clockwise by a drive mechanism, not shown. A first charger or main charger 2 uniformly charges the surface of the drum 1 to, for example, negative polarity. The charged surface of the drum 1 is subjected to first exposure, (laser beam) 3 associated with a black image. As a result, the image portion of the drum 1 is attenuated to form a first electrostatic latent image. A first developing unit 4 develops the latent image by a negatively charged black toner on the basis of reversal development, thereby forming a black toner image on the drum 1. The developing unit 4 is of the type forming a magnetic brush of two-component developer, i.e., mixture of carrier and toner on a developing roller to thereby develop a latent image. The potential on the drum 1 increases in the portion where the black toner is deposited due to the charge of the toner. However, since such a potential is not high enough to eliminate the mixture of colors, a second charger 5 further charges the drum 1 to negative polarity.

Subsequently, the drum 1 is subjected to second exposure (laser beam) 6 associated with a red image. As a result, a second electrostatic latent image is formed on the drum 1. A second developing unit 7 develops this latent image by a negatively charged red toner on the basis of reversal development. Consequently, a bicolor image made up of the black toner image and a red toner image is formed on the drum 1. The developing unit 7 has a developing roller spaced apart from the drum 1 by a gap of about 150 μm and effects non-contact development, i.e., causes a non-magnetic one-component developer (toner) to fly toward the drum 1. Next, a pretransfer charger 8 uniformizes the amount of charge of the bicolor toner image. A paper is positioned on a transfer belt 9 having the rear thereof charged by a transfer charger 10. As the paper closely contacts the drum 1, the bicolor toner image is transferred from the drum 1 to the paper due to the electric field generated by the transfer belt 9. A fixing unit 11 fixes the toner image on the paper by heat. After the image transfer, a precleaning charger 12 charges the drum 1 to uniformize the charge polarity of the remaining toner. Then, a cleaning unit 13 removes the toner remaining on the drum 1. Further, a discharger 14 dissipates the charge also remaining on the drum 1 by light, thereby initializing the drum 1.

When the second developing unit 7 develops the second latent image by the red toner, it is likely that the black toner existing on the drum 1 flies reversely from the drum 1 to the developing roller of the unit 7 due to the difference between the potential of the portion of the drum 1 where the black toner is deposited and the bias potential $V_{B2}$. The reverse flight of the black toner from the drum 1 to the developing roller will be eliminated only if the potential difference is reduced by reducing the amount of uniform charge to be applied by the second charger 5 or by increasing the bias to be applied to the developing unit 7. This, however, reduces the difference between the potential of the portion of the drum 1 where the black toner is absent and the bias potential of the developing unit 7, causing the red toner to contaminate the background to thereby degrade the image quality.

The illustrative embodiment eliminates both the reverse flight of the toner and the contamination of the background. For this purpose, the potential $V_{D2}$ of the portion of the drum 1 where the black toner is present and which affects the reverse flight of the black toner is made low enough to eliminate the reverse flight. On the other hand, the potential of the portion where the black toner is absent is made relatively high.

Figure 3A:
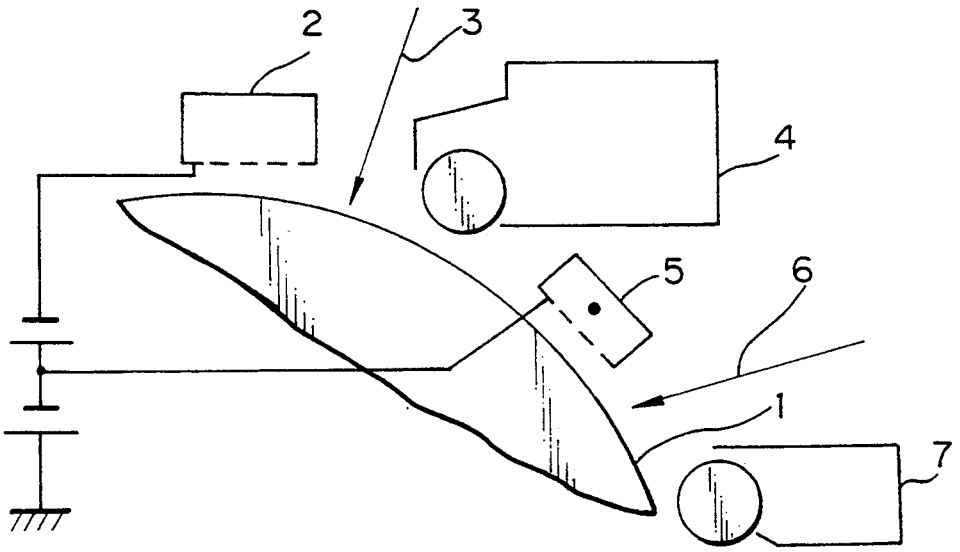
FIG. 3A is a circuit diagram showing a specific connection of a first and a second charger and a power source included in the apparatus of FIG. 2.
Figure 3B:
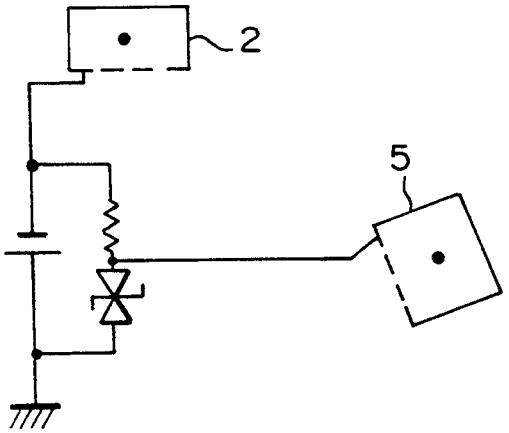
FIG. 3B is a circuit diagram showing another specific connection of the chargers and power source.

To provide each of the portion where the black toner is present and the portion where it is absent with a particular potential as stated above, the embodiment uses a scorotron charger as the second charger 5 and maintains the grid potential of the charger lower than the potential of the portion of the drum 1 where the black toner is absent and having not been charged by such a charger. For example, when the first charger 2 is also implemented by a scorotron charger, the grid voltage of the second charger 5 is selected to be lower than that of the first charger 2, as shown in FIGS. 3A and 3B.

In the above condition, after the black toner image has been formed by the steps (I)-(III), the potential in the portion of the drum 1 where the black toner is present can be made lower than the potential $V_{D2}$ of the portion where the black toner is absent by the charge applied by the second charger 5, as shown in the step (IV) of FIG. 1. Hence, when the second developing unit 7 develops the second latent image having been formed by the step (V) of FIG. 1 (potential $V_{L2}$), it is possible to reduce the difference between the potential of the portion with the black toner and the bias potential $V_{B2}$ relatively while guaranteeing some difference between the potential $V_{D2}$ of the portion without the black toner and the bias potential $V_{B2}$, as shown in the step (VI) of FIG. 1. This is successful in preventing the black toner from flying from the drum 1 toward the second developing unit 7, while insuring a satisfactory margin against the contamination of the background.

Hereinafter will be described an appropriate range of the difference between the potential of the portion of the drum 1 where the black toner is deposited and the bias potential $V_{B2}$ which eliminates the reverse flight of the black toner to the developing unit 7.

Figure 4:
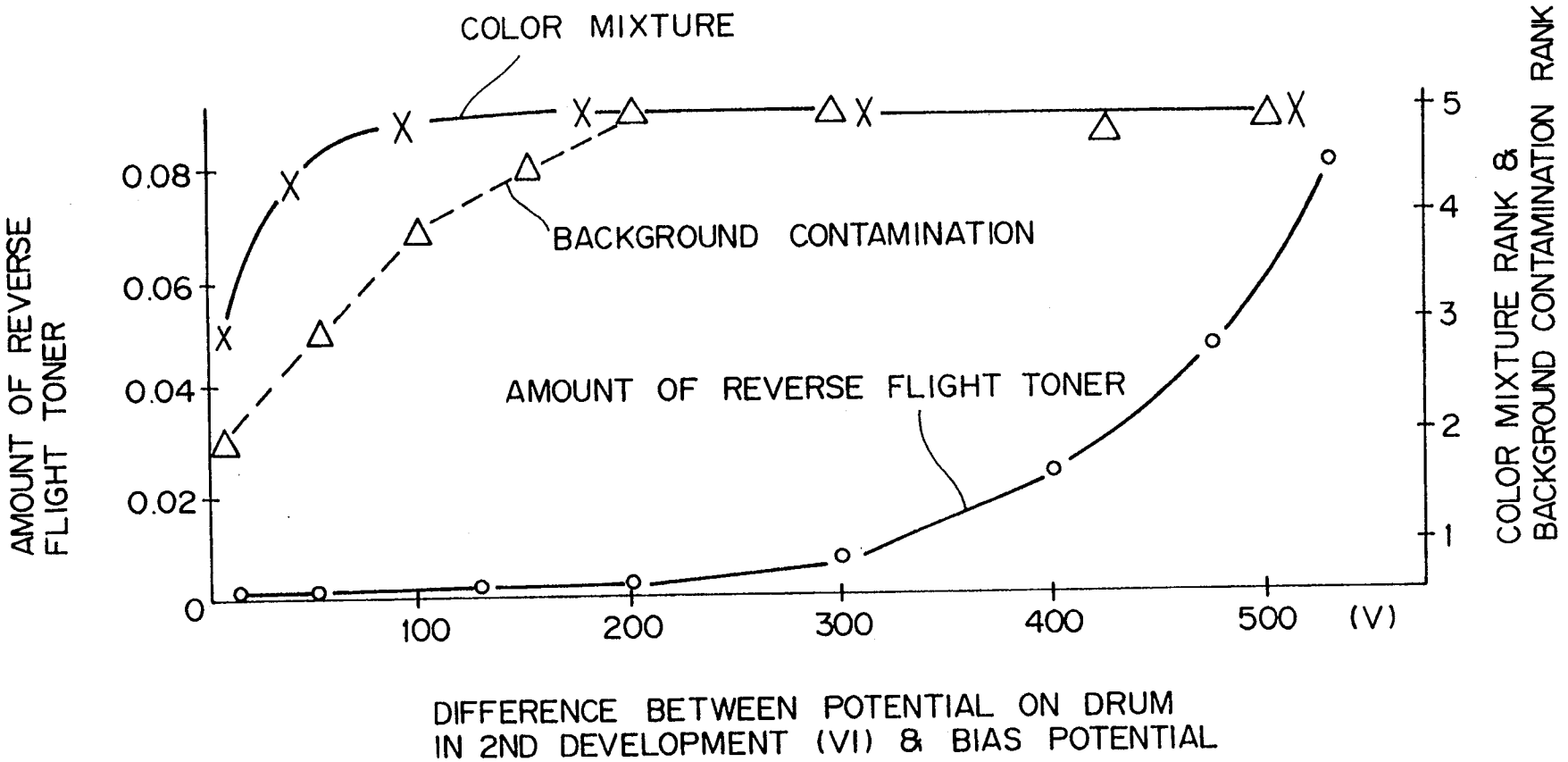
FIG. 4 is graph indicative of a relation of a difference between the potential on the image carrier and the bias potential for development to the amount of reverse flight toner, color mixture rank, and background contamination rank.

FIG. 4 is a graph indicating on the abscissa thereof the difference between the potential of the drum 1 and the bias potential in the event when the developing unit 7 performs reverse development. Specifically, FIG. 4 indicates a relation of such a potential difference particular to the embodiment to the amount of reverse flight toner, color mixture rank (greater the rank number, smaller the mixture), and background contamination rank (greater the rank number, smaller the contamination). The potential difference on the abscissa is the difference between the potential of the portion with the black toner and the bias potential regarding the reverse flight toner and color mixture rank, or the difference between the potential of the portion without the black toner and the bias potential regarding the background contamination rank. As FIG. 4 indicates, considering the fact that the color mixture rank 3 and above are acceptable in respect of image quality, it will be seen that the appropriate range of the difference between the potential of the portion with the black toner and the bias potential is 0 V to 300 V, preferably 0 V to 150 V.

A specific method which allowed the copier to form a bicolor image is as follows. First, the drum 1 was uniformly charged to a potential of about −850 V ($V_{D1}$) by the first charger 2 (step (I), FIG. 1). The charged drum 1 was subjected to first exposure (laser beam) 3 associated with a black image to attenuate the potential of the image portion to about −100 V ($V_{L1}$), thereby forming a first latent image (step (II), FIG. 1). The latent image was developed by reverse development by the first developing unit 4 to which a bias potential of −600 V ($V_{B1}$) was applied. As a result, a black toner image was formed on the drum 1. The surface potential of the drum 1 increased to about −300 V in the portion where the black toner was deposited (step (III), FIG. 1). Then, the drum 1 was further charged by the second charger or scorotron charger 5 to which a grid voltage of −800 V was applied. This changed the potential $V_{D2}$ of the portion with the black toner to about −800 V and the potential $V_{D2}$ of the portion without the black toner to a potential of about −850 V equivalent to the potential deposited by the first charger 2 (step (IV), FIG. 1). Subsequently, the drum 1 was subjected to second exposure (laser beam) 6 associated with a red image to reduce the potential of the image portion to about −120 V ($V_{L2}$). As a result, a second latent image was formed on the drum 1 (step (V), FIG. 1). This latent developed by reverse development by the image was second developing unit 7 to which a bias potential of −700 V ($V_{B2}$) was applied. Consequently, a bicolor toner image made up of the black image and a red image was completed on the drum 1 (step (VI), FIG. 1).

Even when 50,000 bicolor copies were continuously produced by the above procedure, a high image quality with no noticeable color mixture and no impureness was achieved stably. Although some red toner particles were observed through a microscope in the copies at the early stage and in the 500th copy, they were not visible by eye at all. For comparison, the drum 1 was charged by the second charger 5 such that the surface potential was about −850 V throughout the portion with the black toner and the portion without the black toner. Then, although a clear bicolor image was attained in the early stage, the red image, i.e., the image of second color sequentially became impure; the value of the red image was critically lowered when about 1,500 copies were produced and was not usable in practice.

Another specific method is as follows. The drum 1 was uniformly charged to a potential of about −1000 V ($V_{D1}$) by the first charger 2. The portion of the drum 1 carrying the black toner was charged to a potential of about −800 V by the second charger 5. A bias voltage of −700 V ($V_{B2}$) was applied to the second developing unit 7. This was also successful in stably producing bicolor images having a sufficiently high value and whose color mixture and background contamination each lay in an allowable range. For comparison, the drum 1 was uniformly charged to a potential of −800 V ($V_{D1}$) by the first charger 2, the portion of the drum 1 carrying the black toner was charged to about −800 V by the second charger 5 (the potential of the portion without the black toner was also about 800 V), and a bias potential of −700 V ($V_{B2}$) was applied to the second developing unit 7. Under such conditions, although the amount of reverse flight toner and the color mixture were acceptable, the non-image portion of the drum 1 was contaminated to critically degrade the image quality. This was ascribable to the fact that since the potential of the portion of the drum 1 with the black toner and the potential $V_{D2}$ of the portion without the black toner were substantially the same, the difference between such a voltage and the bias potential to the second developing unit 7 was reduced to suppress the reverse flight and, as a result, the difference between the potential of the portion without the black toner and the bias potential $V_{B2}$ to the developing unit 7 was also reduced despite that it should have some size to suppress background contamination. Therefore, it will be seen that a relation that the potential $V_{D2}$ of the portion without the black toner is higher than the potential of the portion with the black toner and a relation that the potential of the portion with the black toner is higher than the bias potential to the developing unit 7 should be satisfied.

Since the characteristic of a photoconductive element, for example, changes due to aging, it is preferable to change the grid voltage of the second charger 5 in matching relation to the characteristic.

Figure 5:
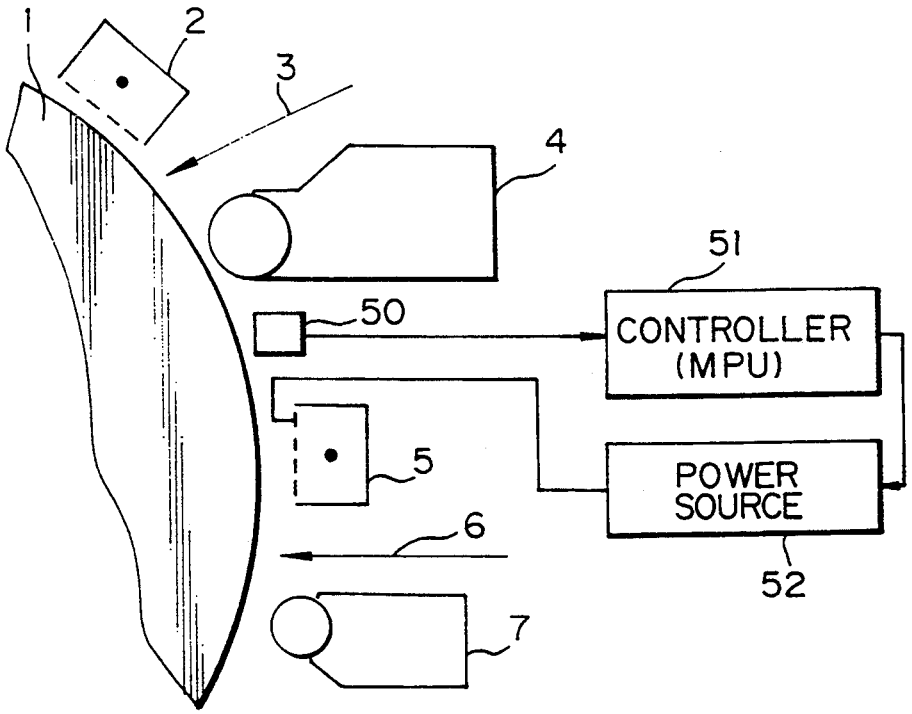
FIG. 5 is a fragmentary sectional side elevation showing a modified form of the apparatus of FIG. 2.

FIG. 5 shows a specific arrangement for sensing the charge potential $V_{D1}$ deposited by the first charger 1 and then controlling the grid voltage of the second charger 5 such that the potential of the portion of the drum 1 carrying the black toner and charged by the second charger 5 is lower than the charge potential $V_{D1}$. As shown, a potential sensor 50 is located to face the drum 1 between the first and second chargers 2 and 5, specifically between the first developing unit 4 and the second charger 5. The output of the potential sensor 50 is applied to a controller 51 implemented by, for example, a microcomputer. In response, the controller 51 sends a control signal to a power source 52 assigned to the grid of the second charger 5. In operation, on the start of a bicolor copying operation, a charged portion formed on the drum 1 upstream of an image forming area by the first charger 2 is brought to the potential sensor 50. Then, the controller 51 reads the resulting output of the potential sensor 50 and sends to the power source 52 a control signal corresponding to a grid voltage which is lower than the charge potential $V_{D1}$ associated with the sensor output by a predetermined quantity, e.g., 50 V. In response, the second charger 5 performs second charge over the image forming area of the drum 1. As a result, assuming that the sensed first charge potential $V_{D1}$ is −900 V, then the second charge is effected at a grid voltage of −850 V which is 50 V lower than $V_{D1}$. Then, the potential of the portion with the black toner image and that of the portion without it are respectively about −830 V and about −900 V, allowing a clear bicolor image to be produced.

The above arrangement is constructed to sense the potential of the charged portion formed by the first charger 2 in the portion without the black toner, i.e., upstream of the image forming area with respect to the rotating direction of the drum 1. Alternatively, a reference image for measurement may be formed on the drum 1 upstream of the image forming area and brought to the potential sensor 50 after being developed or without being developed by the first developing unit 4. Then, the grid voltage of the second charger 5 will be controlled in response to the resulting output of the potential sensor 50 such that a desired potential is deposited in the portion with the black toner. This kind of arrangement is advantageously applicable to, among others, a process setting of the type accommodating a relatively broad range of change in the potential of the portion without the black toner due to aging, and causing the image quality to be more influenced by the change in the potential of the portion with the black toner due to aging. Such an arrangement is also desirable when the charge deposited on the black toner and the amount of deposition thereof on the drum 1 per unit area change due to aging.

If desired, both of the charged portion corresponding to the portion without the black toner and the reference latent image corresponding to the portion with the black toner may be measured to control the grid voltage of the second charger 5.

Figure 6:
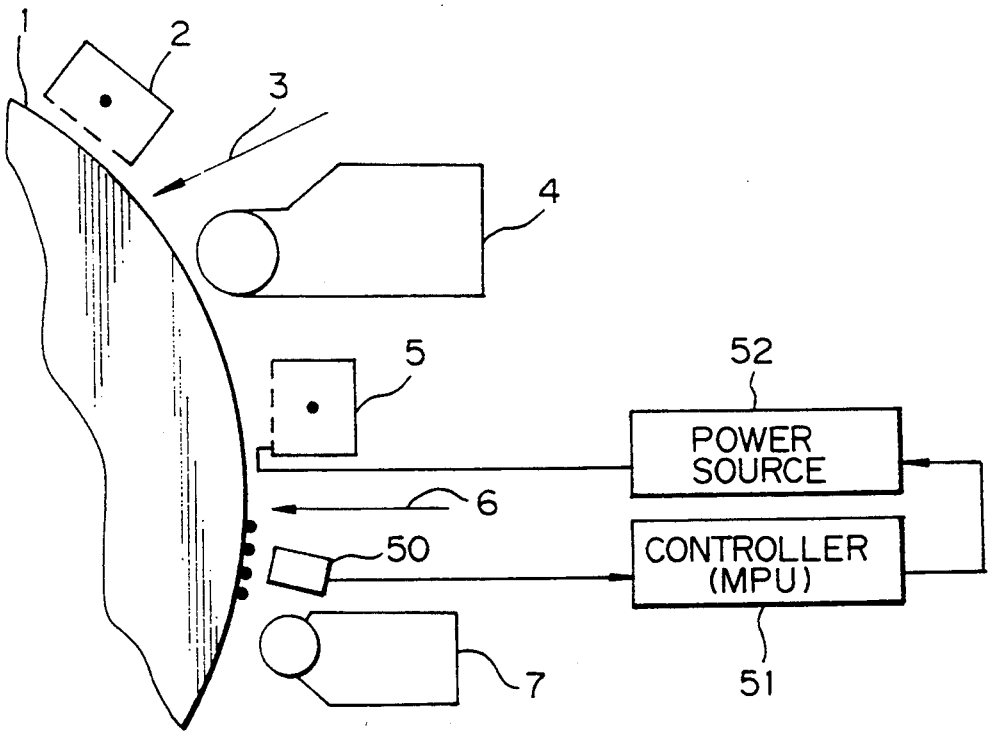
FIG. 6 is a view similar to FIG. 5, showing another modified form of the apparatus of FIG. 2.

In the above procedure, the potential of the drum 1 is sensed before the second charge so as to control the grid voltage of the second charge of the same copying cycle Alternatively, the potential of the drum 1 may be sensed after the second charge so as to control the grid voltage for the second copying cycle and onward. In such a case, as shown in FIG. 6, the potential sensor 50 may be located downstream of the second charger 5, e.g., between the second charger 5 and the second developing unit 7.

The charged portion corresponding to the portion without the black toner and the reference latent image corresponding to the portion with the black toner may even be formed at a position downstream of the image forming area of the drum 1.

In combination or in place of the control of the second charger 5, the bias to the second developing unit 7 may be controlled on the basis of the sensed potentials of the charged portion and reference latent image such that the difference between the drum potential and the bias potential remains in the previously stated adequate range.

While the toner of first color and the toner of second color have been shown and described as comprising respectively a black toner and a red toner, such a combination and order are only illustrative. However, it is desirable that the toner of first color has a smaller value than the toner of second color.

When a toner image is to be formed in three or more colors on the drum 1, impureness and mixture of colors as well as background contamination can be eliminated if the third charge and successive charges are effected such that the potential on the drum 1 is higher in the portions where the toners of first and second colors are absent than in the portions where they are present. Again, it is preferable that the toner for the preceding development be smaller in value than the toner for the succeeding development.

In the illustrative embodiment, the ability of the second charger 5 subsequent to the first charger 2 with respect to the image forming sequence has an ability lower than that of the first charger 2. Hence, the drum 1 is subjected to the second charge with a minimum of ripple superposed on the ripple ascribable to the first charge. This minimizes the irregularity in the charge on the drum surface after the second charge to thereby enhance image quality. At the same time, power consumption, degradation of the drum 1 and the generation of ozone are reduced.

Figure 7:
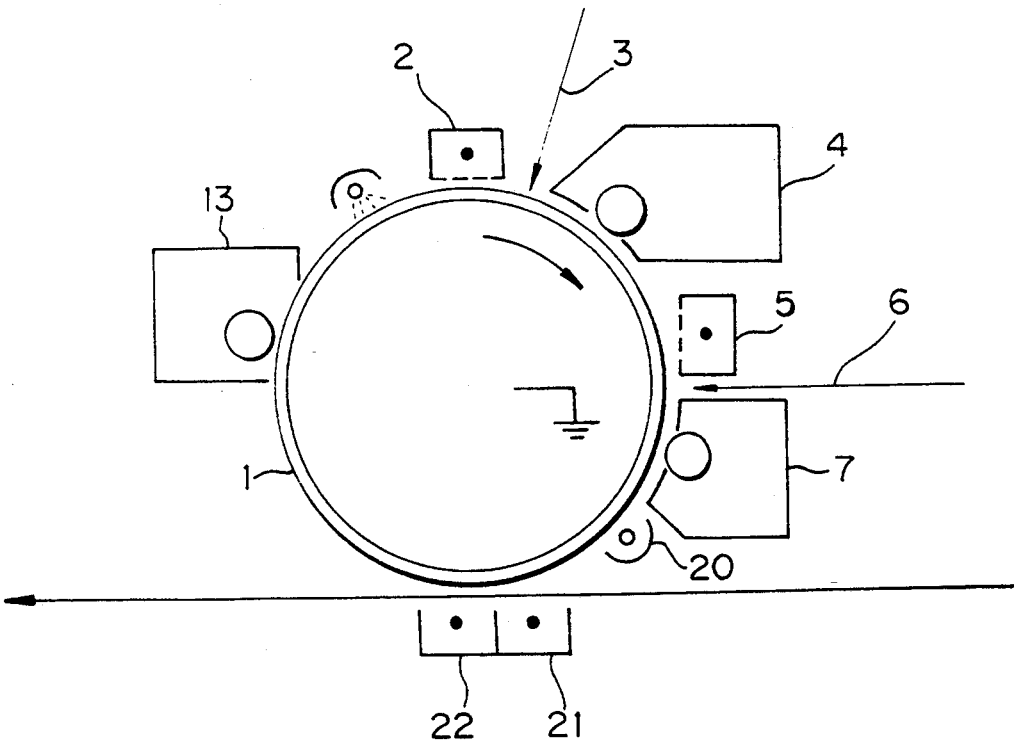
FIG. 7 is a sectional side elevation showing a bicolor image forming apparatus embodying the present invention.
Figure 8A:
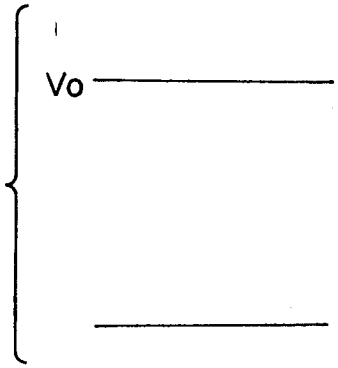
FIG. 8 shows the surface potentials of a photoconductive element deposited by a sequence of steps to be executed by the apparatus shown in FIG. 7.
Figure 8B:
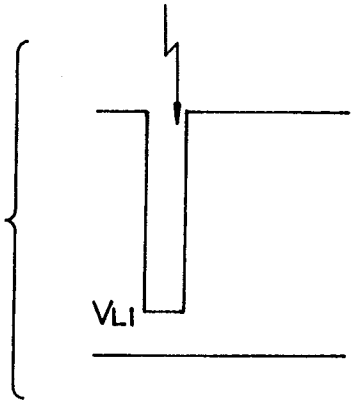
Figure 8C:
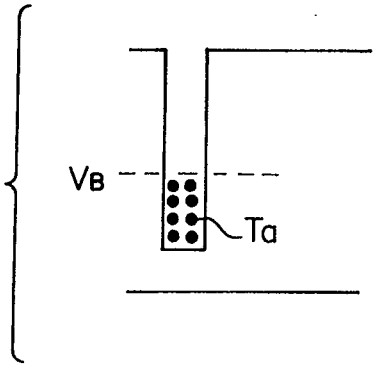
Figure 8D:
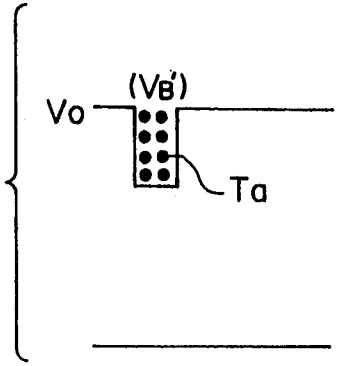
Figure 8E:
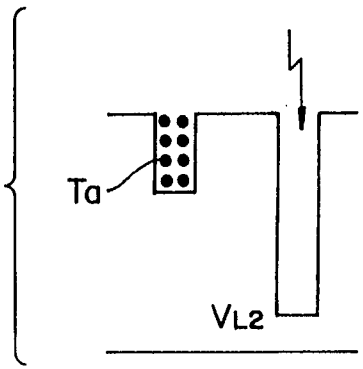
Figure 8F:
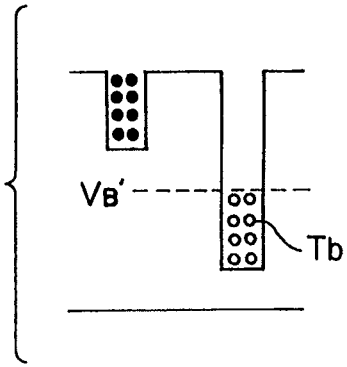

Referring to FIG. 7, a bicolor image forming apparatus embodying the present invention is shown. As shown, a laser, not shown, for issuing the laser beam 3 and playing the role of first exposing means, the first developing unit 4, the second charger 5, an LED (Light Emitting Element) light source, not shown, which is second exposing means, the second developing unit 7, a pretransfer discharger in the form of a lamp 20, a pretransfer charger 21, a separation charger 22, the cleaning unit 13 and the discharger 14 are arranged around the drum 1. The first and second chargers 2 and 5 each uniformly deposits a predetermined charge (negative in the embodiment) on the surface of the drum 1 by corona discharge.

In operation, the first charger 2, e.g., scorotron charger uniformly charges the surface of the drum 1 to set up a surface potential $V_0$, as shown in a step (I) of FIG. 8. At this instant, the grid of the first charger 2 and the casing are held at the same potential, and the total current $I_{cc1}$ is provided such that the grid bias $V_{G1}$ to the charger 2 is equal to the first target charge potential $V_0$. The laser beam 3 scans the charged surface of the drum 1, i.e., executes the first negative exposure to form a first latent image having a potential $V_{L1}$, as shown in a step (II) of FIG. 8. The first latent image is developed by a toner Ta of first color having been charged to negative polarity. At this instant, a bias voltage $V_B$ to the developing roller of the first developing unit 4 is selected to be lower than the background potential $V_O$. Since the toner Ta of first color deposits on the first latent image, the surface potential of the drum 1 rises to $V_B$ after the development, as shown in a step (III) of FIG. 8.

Subsequently, the second charger or scorotron charger 5 again uniformly charges the surface of the drum 1. Here, a grid bias $V_{G2}$ to the charger 5 is selected such that the potential $V_B$ of the first developed portion where the toner Ta of first toner is present is slightly lower than the potential $V_O$ of the non-image portion which is the target value of the first charge potential. In this condition, the LED light source 6 executes the second negative exposure to form a second latent image having a potential $V_{L2}$ on the drum 1, as shown in a step (V) of FIG. 8. The second latent image is developed by the second developing unit 7 storing a negatively charged toner Tb of second color and effecting reversal development. A bias voltage $V_B'$ applied to the developing roller of the developing unit 7 is equal to the bias voltage $V_B$ applied to the developing roller of the developing unit 4.

By the sequence of steps (I)–(V), toner images of first and second colors are formed on the drum 1, as shown in a step (VI) of FIG. 8. Thereafter, the drum 1 is discharged by the pretransfer discharge lamp 20. Then, the toner images of first and second colors are transferred to a paper by the transfer charger 21. The paper carrying the toner image is separated from the drum 1 by the separation charger 22. The cleaning unit 13 removes the toner remaining on the drum 1 after the image transfer. Finally, the discharger 14 dissipates the charge also remaining on the drum 1 after image transfer.

As stated above and indicated in the step (IV) of FIG. 8, this embodiment effects the second charge before the second development such that the first image portion has a slightly lower potential than the non-image portion, thereby raising the potential of the first image portion. As a result, even if the second charge is performed as in the conventional arrangement, the embodiment eliminates the limitation that the second bias for development has to be lower than the first bias since, should the second bias be greater higher than or equal to the first bias, the first image portion would be developed by the second toner to cause color mixture to occur.

Further, in the illustrative embodiment, the second charge is performed such that the portion of the drum 1 where the first toner is absent has a higher potential than the portion where it is present. This provides a relatively great difference between the bias for second development and the potential of the portion where the first toner is absent, thereby protecting the background from contamination. At the same time, the difference between the bias for second development and the potential of the portion where the first toner is present is made relatively small to prevent the first toner from flying reversely to the second developing unit 7. These in combination insure an attractive bicolor image. In addition, the second charge allows the bias for second development to be set in the same manner as the bias for first development and makes it possible to provide the first and second development with the same contrast, i.e., the same difference between the bias voltage for development and the potential of the exposed portion. Therefore, the first and second development are identical in image density and the width of lines, further enhancing the image quality.

The second charger simply raises the potential of the first image portion approximately to the potential of the non-exposed portion and, therefore, does not need a high ability. Specific numerical values will be described with reference to FIGS. 9A–9C and 10A–10C.

Figure 9A:
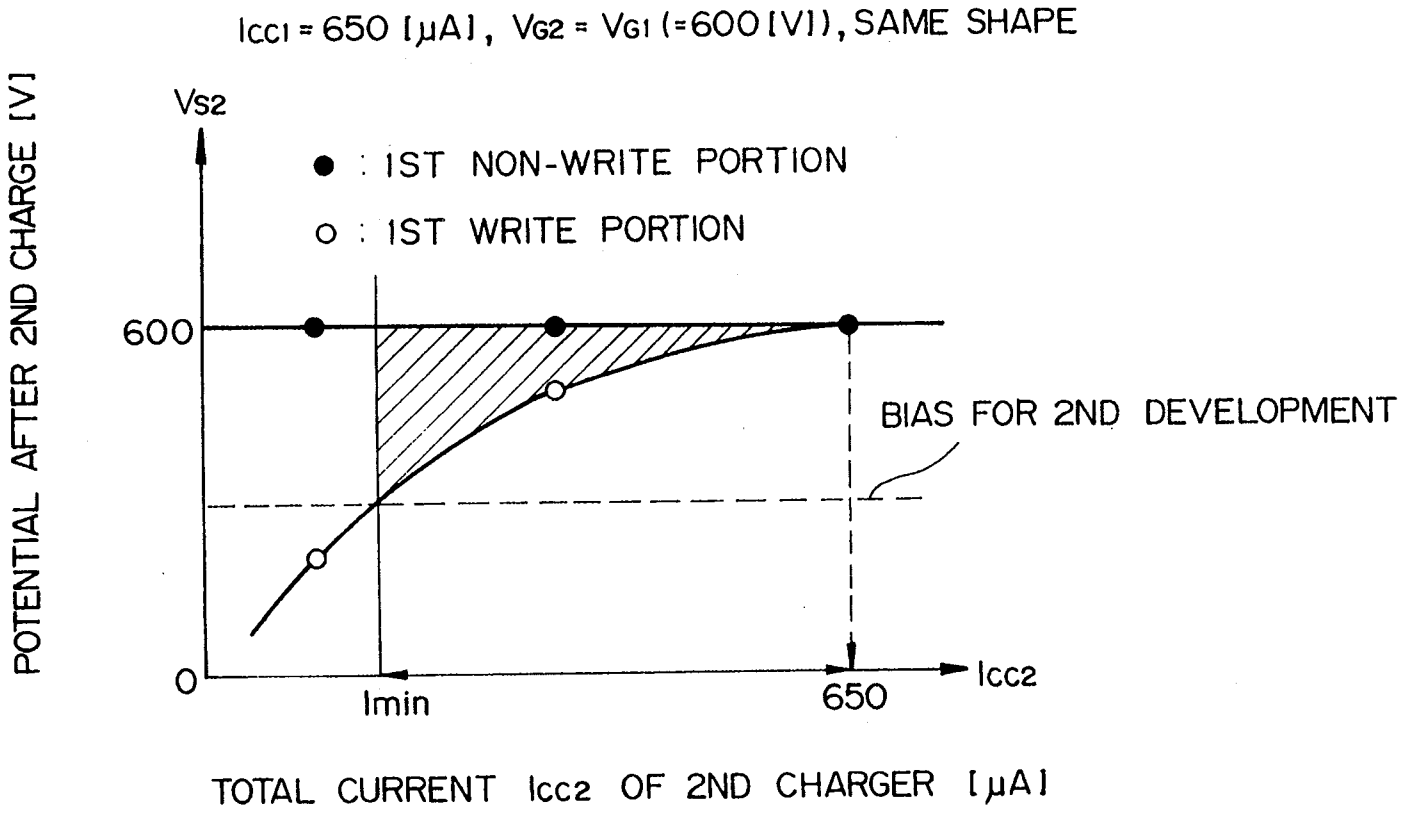
FIG. 9A plots a relation between the charge potential and the total current of a second charger.
Figure 9B:
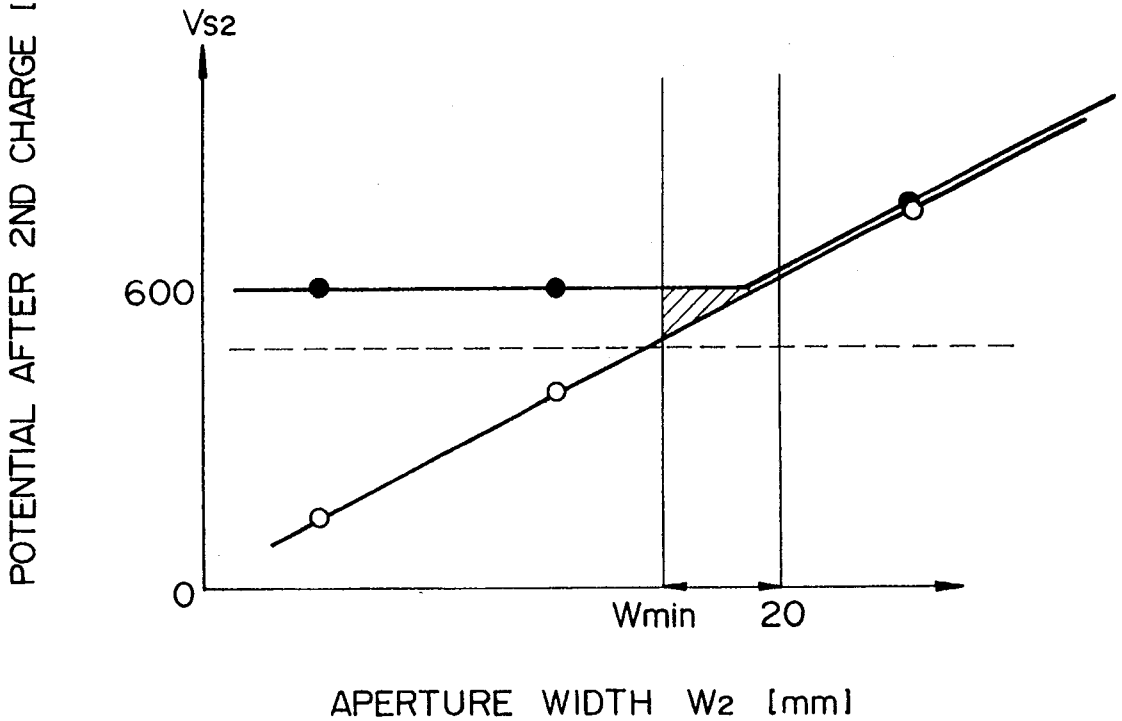
FIG. 9B plots a relation between the charge potential and the aperture width of the second charger.

FIG. 9A plots a relation between the charge potential and the total current. As shown, as the total current $I_{cc2}$ of the second charger approaches the total current $I_{cc1}=650$ [$\mu$A] of the first charger, the potential of the first writing portion approaches the potential of the first non-writing portion, i.e., the target potential $V0=600$ [V] of the first charge. Labeled $I_{min}$ in FIG. 9A is the lower limit of the total current of the second charge and determined by the bias for second development VB [V]. The total current required of the second charge is $I_{min} \leqq I_{cc2} \leqq I_{cc1}$.

FIG. 9 shows a relation between the aperture width of the second charger and the potential set up after the second charge. As shown, when the aperture width is equal to that of the first charger, the potential of the writing portion is equal to the potential of the non-writing portion, i.e., the target potential VO=600 [V] of the first charge. The lower limit $W_{min}$ of the aperture width is also determined by the bias for second development $V_B$ [V].

Figure 9C:
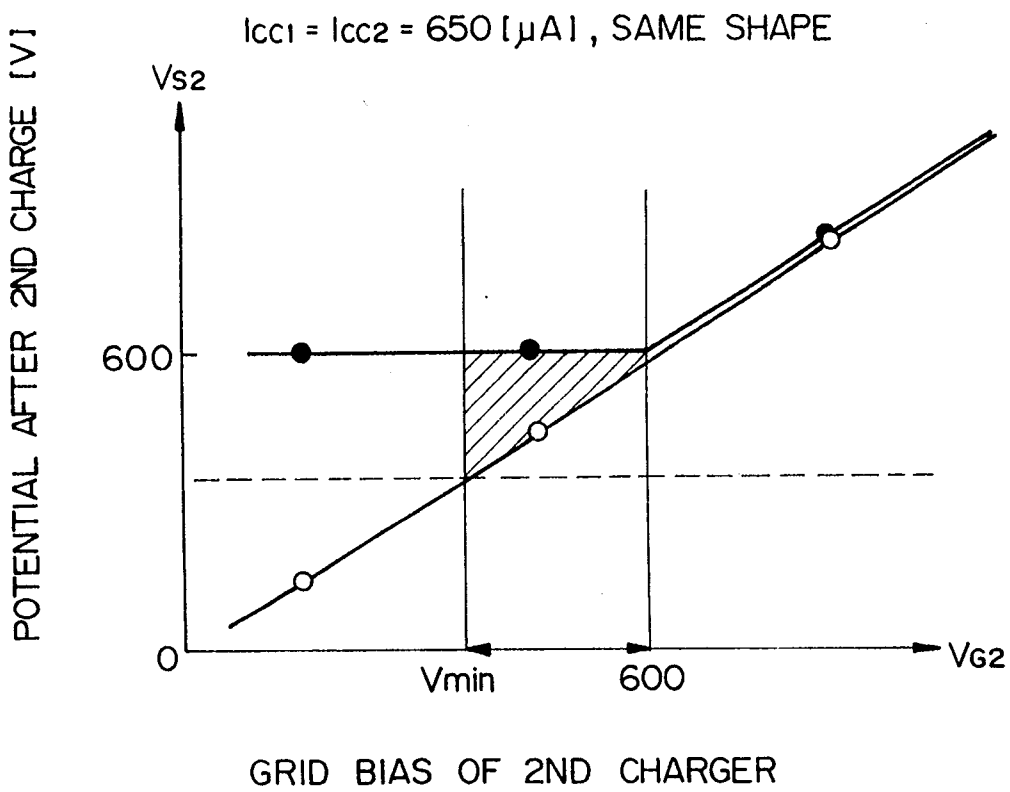
FIG. 9C plots a relation between the charge potential and the grid bias potential of the second charger.

FIG. 9C shows a relation between the grid bias potential VG2 of the second charger and the potential deposited after the second charge. As shown, when the grid bias $V_{G2}$ of the second charger is equal to the grid bias VG1=600 [V] of the first charger, the potential of the writing portion is substantially equal to the potential of the non-writing portion, i.e., the target potential VO=600 [V] of the first charge. Labeled $V_{min}$ is the lower limit of the second grid bias and determined by the bias for second development $V_B$ [V], as stated with reference to FIG. 9A.

Figure 10A:
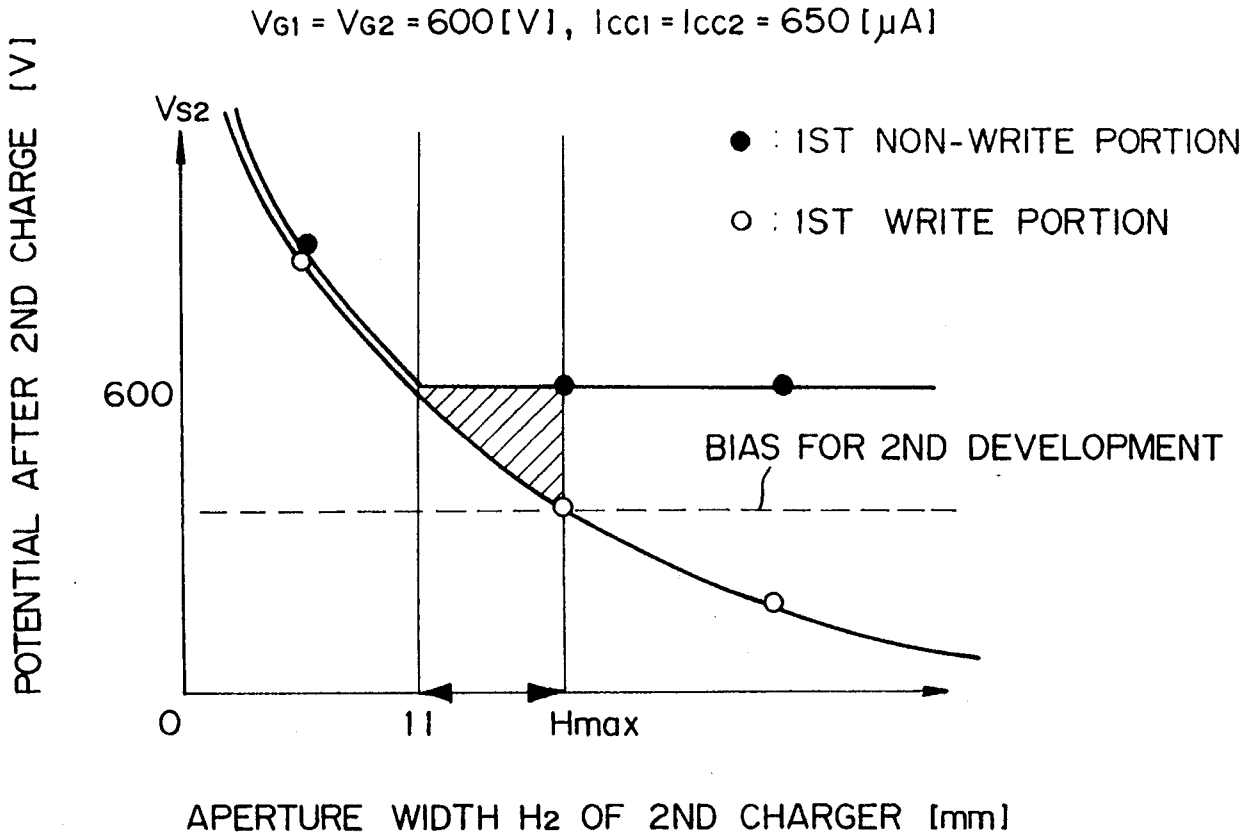
FIG. 10A plots a relation between the charge potential and the wire height of the second charger.

FIG. 10A plots a relation between the wire height $H_2$ of the second charger and the potential deposited after the second charge. As shown, when the wire height $H_2$ of the second charger is equal to the wire height $H_1=11$ [mm] of the first charger, the potential of the writing portion is equal to the potential of the non-writing portion, i.e., the target potential VO=600 [V] of the first charge. Labeled $H_{MAX}$ is a value determined by the bias for second development $V_B$ [V].

Figure 10B:
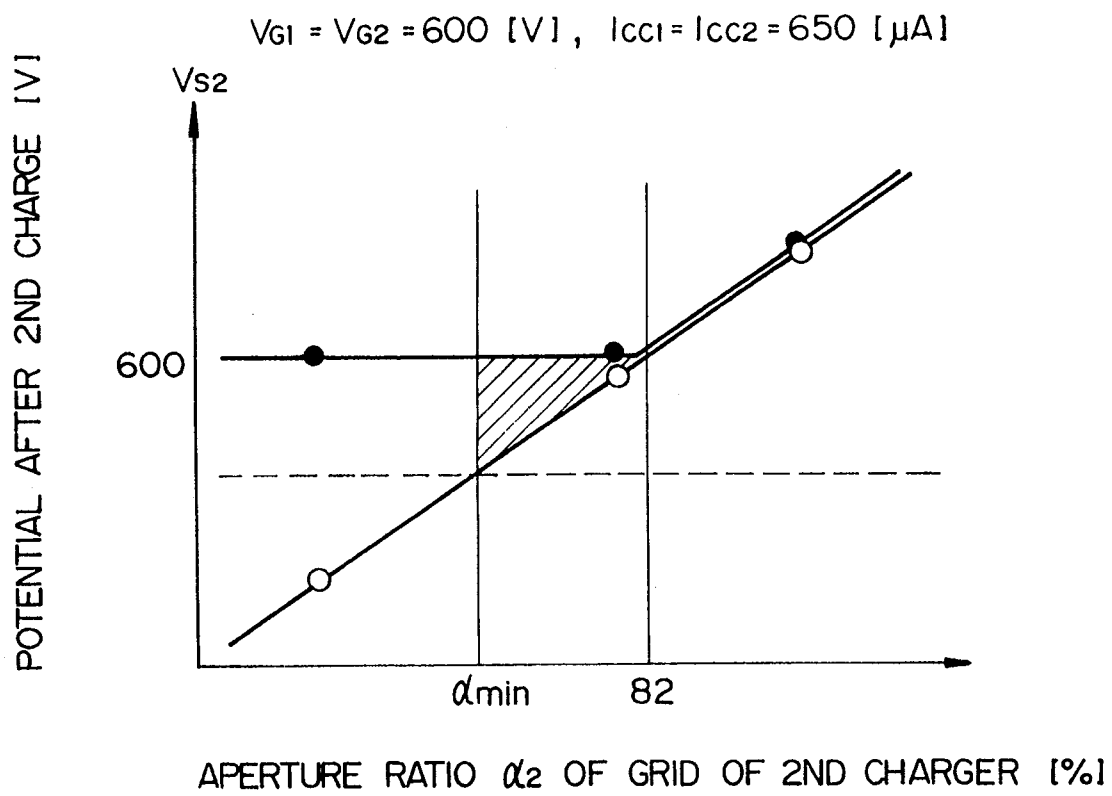
FIG. 10B plots a relation between the charge potential and the aperture ratio of the grid of the second potential.

FIG. 10B indicates a relation between the aperture ratio $\alpha_2$ of the grid of the second charger and the potential deposited after the second charge. As shown, when the aperture ratio $\alpha_2$ of the second charger is equal to the aperture ratio $\alpha_1=82$ [%] of the first charger, the potential of the writing portion is equal to the potential of the non-writing portion, i.e., the target potential VO=600 [V] of the first charge. Labeled $\alpha_{min}$ is the lower limit of the aperture ratio of the second charger and determined by the bias for second development VB [V].

In summary, in accordance with the present invention, an image carrier carrying a first toner image thereon is charged such that the potential of the portion of the image carrier where the toner constituting the first toner image is absent is higher than the potential of the portion where the toner is present. As a result, the bias potential for the reversal development of a latent image formed by the above-mentioned charge and the potential of the portion of the image carrier where the toner is absent is made great enough to protect the background from contamination. Further, the difference between the bias potential for the development and the potential of the portion of the image carrier where the toner of the first image is present is made small enough to prevent the toner of the first toner image from flying reversely to a developing unit expected to develop a latent image which will be formed after the charging. These in combination insure an attractive multicolor image having a clear background and free from impureness ascribable to the reverse flight of the toner.

The difference between the bias potential for the reverse development of the latent image formed after the charging and the potential of the portion of the image carrier where the toner constituting the first toner image is present is relatively small, as stated above. Hence, the toner of the developing unit which develops the latent image formed after the charging by reversal development deposits on the portion of the image carrier where the toner of the first toner image is present, resulting in some color mixture. However, the image quality remains in an allowable range. Particularly, the image quality falls little when use is made of a toner having a small value, e.g., a black toner as the toner forming the first toner image. This insures a desirable multicolor image although the characteristics of the image carrier, for example, may deteriorate due to aging.

Further, the image carrier is subjected to the second charge with a minimum of ripple superposed on the ripple ascribable to the first charge. This minimizes the irregularity in the charge on the image carrier surface after the second charge to thereby enhance image quality. At the same time, power consumption, degradation of the drum 1 and generation of ozone are reduced.

Various modifications will become possible for those skilled in the art after receiving the teachings of the present disclosure without departing from the scope thereof.

What is claimed is:

1. A multicolor image forming method for forming toner images of at least two colors, comprising the steps of:

primary charging an image carrier to a predetermined potential by applying a first voltage to the image carrier;

forming a first image pattern on the image carrier;

depositing toner of a first color on the first image pattern;

secondary charging said image carrier at portions where a charge from the primary charging remains by applying a second voltage to the image carrier, the second voltage being less than the first voltage so that a potential of the image carrier at portions where the toner of the first color is deposited is lower than a potential of the image carrier at portions where the toner of the first color is absent and is lower than the predetermined potential of the primary charging;

forming a second image pattern on the image carrier;

depositing toner of a second color on the image carrier where toner of the first color is not deposited; and transferring the toner of the first and second color from the image carrier to a recording medium for forming a multicolor image.

2. The method as claimed in claim 1, wherein the charging is implemented by a scorotron charger.

3. The method as claimed in claim 1, wherein the step of forming the second image pattern comprises applying a bias for development to the image carrier which is lower in potential than the potential of the portions of the image carrier where the toner of the first color is deposited.

4. The method as claimed in claim 1, further comprising the steps of:

sensing, after the secondary charging, at least one of the potential of the portions of the image carrier where the toner of the first color is deposited and the portions where the toner of the first color is absent; and controlling an amount of charge to be deposited by the secondary charging on the basis of the sensed potential.

5. The method as claimed in claim 1, further comprising the steps of:

sensing, before the reversal development, at least one of the potential of the portions of the image carrier where the toner of the first color is deposited and the portions where the toner of the first color is absent; and controlling a size of a bias potential for the reverse development on the basis of the sensed potential.

6. The method as claimed in claim 1, further comprising the steps of:

applying a first bias potential to the toner of the first color; and applying a second bias potential to the toner of the second color, the second bias potential being less than the first bias potential.

7. A multicolor image forming method for forming toner images of at least two colors, comprising the steps of:

first charging means for charging an image carrier to a predetermined potential by applying a first voltage to the image carrier;

first forming means for forming a first image pattern with toner of a first color deposited thereon on the image carrier;

second charging means for charging said image carrier at portions where a charge from the primary charging remains by applying a second voltage to the image carrier, the second voltage being less than the first voltage so that a potential of the image carrier at portions where the toner of the first color is deposited is lower than a potential of the image carrier at portions where the toner of the first color is absent and is lower than the predetermined potential of the first charging;

second forming means for forming a second image pattern with toner of a second color deposited thereon on the image carrier where toner of the first color is not deposited; and transferring means for transforming the toner of the first and second colors from the image carrier to a recording medium for forming a multicolor image.

8. The apparatus as claimed in claim 7, wherein said first charging means comprises a first scorotron charger.

9. The apparatus as claimed in claim 8, wherein said second charging means comprises a second scorotron charger.

10. The apparatus as claimed in claim 9, wherein a grid voltage applied to said first scorotron charger is lower than a grid voltage applied to said second scorotron charger.

11. The apparatus as claimed in claim 9, wherein said first scorotron charger and said second scorotron charger are identical in configuration except that said first scorotron charger is smaller in total current than said second scorotron charger.

12. The apparatus as claimed in claim 7, wherein said first forming means applies a first bias potential to the toner of the first color, and said second forming means applies a second bias potential to the toner of the second color, wherein the second bias potential is less than the first bias potential.

13. A multicolor image forming method for forming toner images of at least two colors, comprising the steps of:

primary charging an image carrier to a predetermined potential;

forming a first image pattern on the image carrier;

depositing toner of a first color on the first image pattern;

sensing at least one of the potential of the portions of the image carrier where the toner of the first color is deposited and the portions where the toner of the first color is absent;

secondary charging said image carrier in a predetermined manner so that a potential of the image carrier at portions where the toner of the first color is deposited is lower than a potential of the image carrier at portions where the toner of the first color is absent and is lower than the predetermined potential of the primary charging, and wherein an amount of charge to be deposited by the secondary charging is controlled on the basis of the sensed potential;

forming a second image pattern on the image carrier;

depositing toner of a second color on the second image pattern by reversal development; and transferring the toner of the first and second colors from the image carrier to a recording medium for forming a multicolor image.

14. The method as claimed in claim 13, wherein the charging is implemented by a scorotron charger.

15. The method as claimed in claim 13, wherein the step of forming the second image pattern comprises applying a bias for development to the image carrier which is lower in potential than the potential of the portions of the image carrier where the toner of the first color is deposited.

16. A multicolor image forming apparatus for forming toner images of at least two colors, comprising:

a first scoroton charger for charging an image carrier to a predetermined potential;

first forming means for forming a first image pattern with toner of a first color deposited thereon on the image carrier;

a second scorotron charger for charging said image carrier in a predetermined manner so that a potential of the image carrier at portions where the toner of the first color is deposited is lower than a potential of the image carrier at portions where the toner of the first color absent and is lower than the predetermined potential of the first charging;

second forming means for forming a second image pattern with toner of a second color deposited thereon on the image carrier; and transferring means for transferring the toner of the first and second colors from the image carrier to a recording medium for forming a multicolor image;

wherein said first scorotron charger and said second scorotron charger are identical in total current and grid voltage, said first scorotron charger having a smaller aperture width than said second scorotron charger.

17. The apparatus as claimed in claim 16, wherein a grid voltage applied to said first scorotron charger is lower than a grid voltage applied to said second scorotron charger.

18. A multicolor image forming apparatus for forming toner images of at least two colors, comprising:

a first scoroton charger for charging an image carrier to a predetermined potential;

first forming means for forming a first image pattern with toner of a first color deposited thereon on the image carrier;

a second scorotron charger for charging said image carrier in a predetermined manner so that a potential of the image carrier at portions where the toner of the first color is deposited is lower than a potential of the image carrier at portions where the toner of the first color is absent and is lower than the predetermined potential of the first charging;

second forming means for forming a second image pattern with toner of a second color deposited thereon on the image carrier; and transferring means for transferring the toner of the first and second colors from the image carrier to a recording medium for forming a multicolor image;

wherein said first scorotron charger and said second scorotron charger are identical in total current and grid voltage, said first scorotron charger having a greater wire height than said second scorotron charger.

19. The apparatus as claimed in claim 18, wherein a grid voltage applied to said first scorotron charger is lower than a grid voltage applied to said second scorotron charger.

20. A multicolor image forming apparatus for forming toner images of at least two colors, comprising:

a first scoroton charger for charging an image carrier to a predetermined potential;

first forming means for forming a first image pattern with toner of a first color deposited thereon on the image carrier;

a second scorotron charger for charging said image carrier in a predetermined manner so that a potential of the image carrier at portions where the toner of the first color is deposited is lower than a potential of the image carrier at portions where the toner of the first color is absent and is lower than the predetermined potential of the first charging;

second forming means for forming a second image pattern with toner of a second color deposited thereon on the image carrier; and transferring means for transferring the toner of the first and second colors from the image carrier to a recording medium for forming a multicolor image;

wherein said first scorotron charger and said second scorotron charger are identical in total current and grid voltage, said first scorotron charger having a smaller grid aperture ratio than said second scorotron charger.

21. The apparatus as claimed in claim 20, wherein a grid voltage applied to said first scorotron charger is lower than a grid voltage applied to said second scorotron charger.

* * * * *